US007669934B1

(12) United States Patent
Cline

(10) Patent No.: US 7,669,934 B1
(45) Date of Patent: Mar. 2, 2010

(54) ADJUSTABLE LEG REST

(76) Inventor: Thomas E Cline, 1744 Golfview, Kissimmee, FL (US) 34746

( * ) Notice: Subject to any disclaimer, the term of this patent is extended or adjusted under 35 U.S.C. 154(b) by 0 days.

(21) Appl. No.: 12/285,861

(22) Filed: Oct. 15, 2008

(51) Int. Cl.
*A47C 7/50* (2006.01)

(52) U.S. Cl. ..... 297/423.45; 294/217.3; 294/423.46

(58) Field of Classification Search ..... 297/423.11, 297/423.12, 423.13, 423.41, 423.45, 423.46; 5/648, 651
See application file for complete search history.

(56) References Cited

U.S. PATENT DOCUMENTS

| | | | | |
|---|---|---|---|---|
| 2,248,369 | A | 7/1941 | Ludersen | |
| 2,375,225 | A * | 5/1945 | Herbert | 297/423.4 |
| 2,878,493 | A * | 3/1959 | Delia | 5/651 |
| 2,978,713 | A | 7/1961 | Scalzitti et al. | |
| 3,520,572 | A | 7/1970 | Flaugh | |
| 4,713,846 | A | 12/1987 | Hodroski, Jr. | |
| 4,767,160 | A * | 8/1988 | Mengshoel et al. | 297/423.12 |
| 4,873,966 | A * | 10/1989 | Gitter | 297/423.43 |
| D327,176 | S | 6/1992 | Gil | |
| 5,593,212 | A * | 1/1997 | Praria et al. | 297/423.44 |
| 5,765,921 | A * | 6/1998 | Chuang | 297/423.46 |
| 6,148,448 | A | 11/2000 | Urso | |
| 6,631,524 | B1 * | 10/2003 | Dixon | 297/423.45 |
| 6,681,410 | B1 | 1/2004 | Husain | |
| 6,874,184 | B2 * | 4/2005 | Chandler | 5/648 |
| 7,228,579 | B2 | 6/2007 | Tidwell | |
| 7,322,949 | B2 * | 1/2008 | Shimizu | 601/90 |
| 2007/0200392 | A1 | 8/2007 | Eiswirth | |
| 2007/0261165 | A1 | 11/2007 | Tran | |
| 2007/0278834 | A1 * | 12/2007 | Kielland | 297/170 |

FOREIGN PATENT DOCUMENTS

| | | | |
|---|---|---|---|
| DE | 4302611 | A1 | 8/1994 |
| DE | 19502505 | C1 | 1/1996 |
| DE | 29808446 | U1 | 1/1999 |
| DE | 20312234 | U1 | 10/2003 |
| GB | 2274244 | A | 1/1993 |

* cited by examiner

*Primary Examiner*—Peter R. Brown
(74) *Attorney, Agent, or Firm*—Richard C. Litman

(57) ABSTRACT

The adjustable leg rest is a support for a user's legs. The adjustable leg rest includes a base and a vertical support. A lower end of the vertical support is secured to an upper surface of the base. The vertical support has an adjustable height and may be a telescopic tube or the like. A horizontal support is secured to the vertical support, with the horizontal support having laterally opposed first and second ends. First and second support pads are secured to the horizontal support, with each of the first and second support pads being respectively positioned adjacent one of the first and second ends of the horizontal support. Each of the first and second support pads is angularly adjustable with respect to the horizontal support. The support pads are formed as cushions or the like, and each has an upper surface adapted for supporting a leg of the user.

7 Claims, 6 Drawing Sheets

ADJUSTABLE LEG REST

BACKGROUND OF THE INVENTION

1. Field of the Invention

The present invention relates to furnishings, and particularly to an adjustable leg rest that provides height adjustable supports for the lower legs.

2. Description of the Related Art

Although foot and leg rests are well known in the art, such rests are typically either joined to a seat or other support surface, or are manufactured as a unitary structure, such as an ottoman, for example. Fixed leg rests, such as those attached to the base of a chair or fixed to a hospital bed, for example, are not portable, and typically have a very limited range of adjustment options.

Although ottomans and the like are portable, they do not provide any sort of adjustment options. Users with particular medical problems, or who simply require adjustment of the leg support for comfort, would benefit from a portable leg rest, which allows for adjustment in both height and in the angle of inclination of the leg supporting surface. Thus, an adjustable leg rest solving the aforementioned problems is desired.

SUMMARY OF THE INVENTION

The adjustable leg rest is a support for a user's legs. The adjustable leg rest includes a base having opposed upper and lower surfaces, with the lower surface thereof being adapted for positioning on a support surface. A vertical support having opposed upper and lower ends is further provided, with the lower end thereof being secured to the upper surface of the base. The vertical support has an adjustable height and may be a telescopic tube or the like.

A horizontal support is secured to the vertical support, adjacent the upper end thereof, with the horizontal support having laterally opposed first and second ends. First and second support pads are secured to the horizontal support, with each of the first and second support pads being respectively positioned adjacent one of the first and second ends of the horizontal support. Each of the first and second support pads is angularly adjustable with respect to the horizontal support. The support pads are formed as cushions or the like, and each has an upper surface adapted for supporting a leg of the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
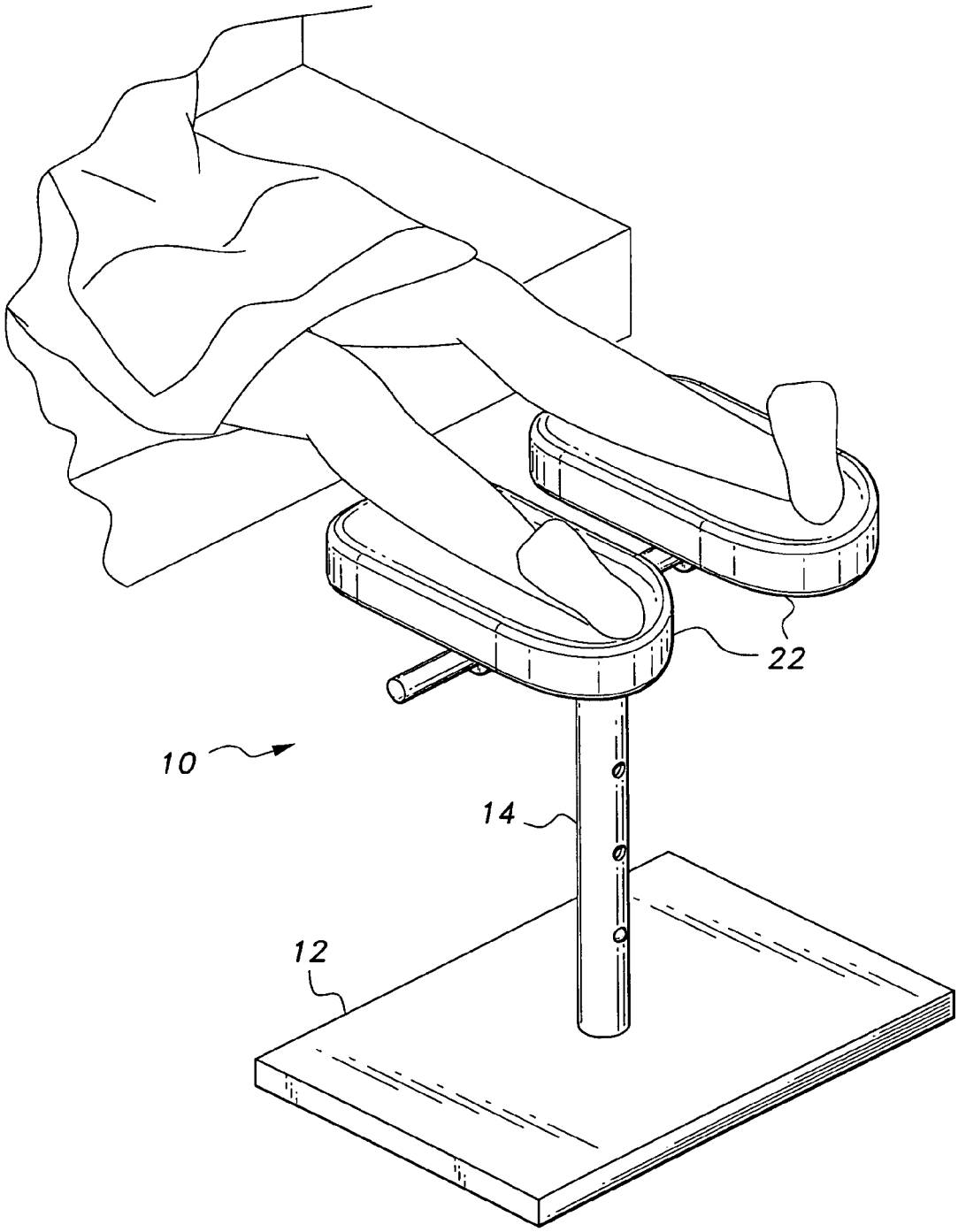
FIG. 1 is an environmental, perspective view of an adjustable leg rest according to the present invention.
Figure 2:
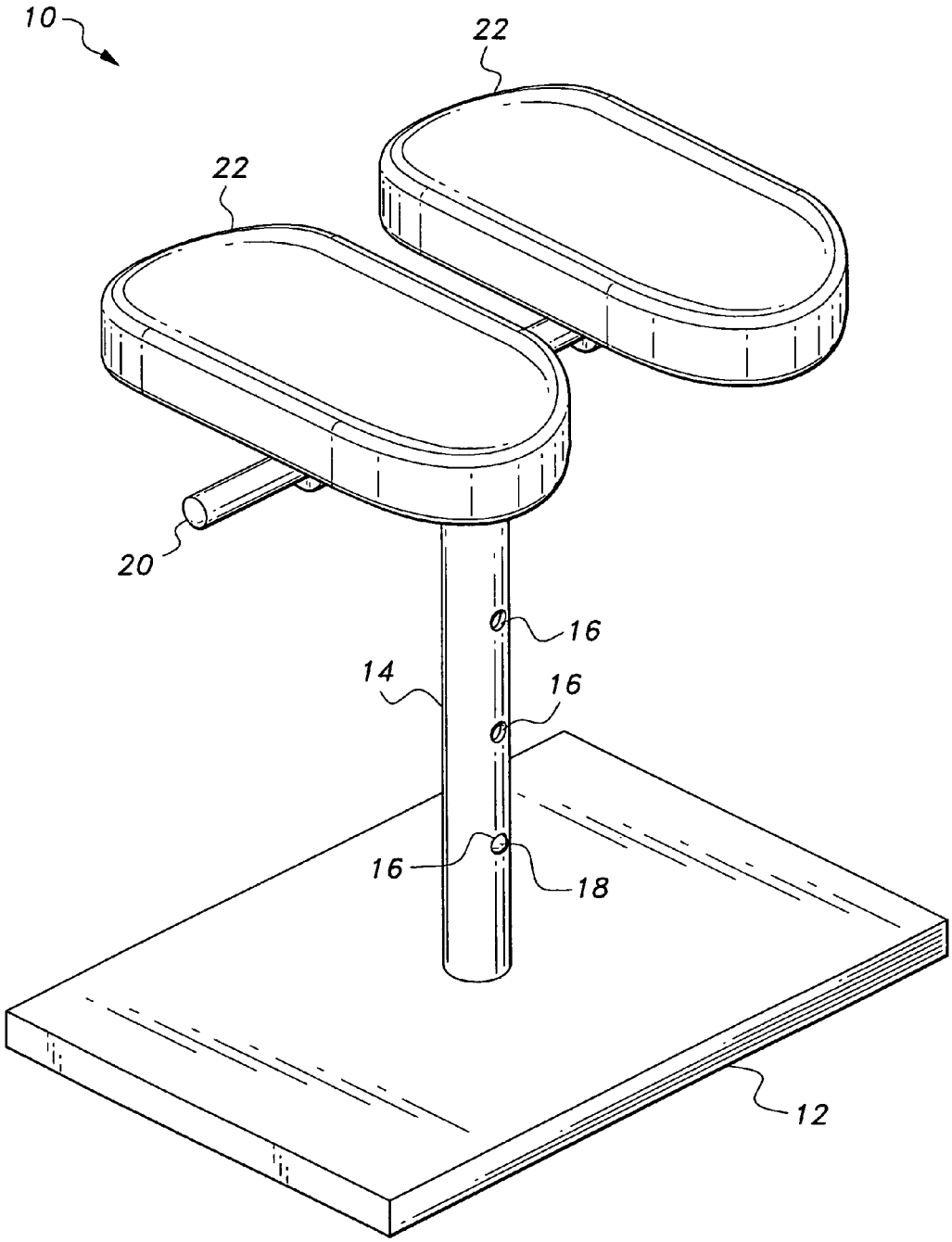
FIG. 2 is a perspective view of the adjustable leg rest according to the present invention.

The adjustable leg rest 10 is a support for a user's legs. As shown in FIG. 1, and as will be described in greater detail below, the adjustable leg rest 10 includes two cushioned support pads 22, providing support for both of the user's legs. As best shown in FIGS. 1 and 2, the adjustable leg rest 10 includes a base 12 having opposed upper and lower surfaces, with the lower surface thereof being adapted for positioning on a support surface. In FIG. 1, adjustable leg rest 10 is shown being supported on the floor, though the lower surface of base 12 may rest on any suitable support surface, such as a couch, a desk, an outside porch or the like. It should be understood that adjustable leg rest 10 is portable, and may be moved between a variety of locations and rested on a variety of differing support surfaces.

Figure 3:
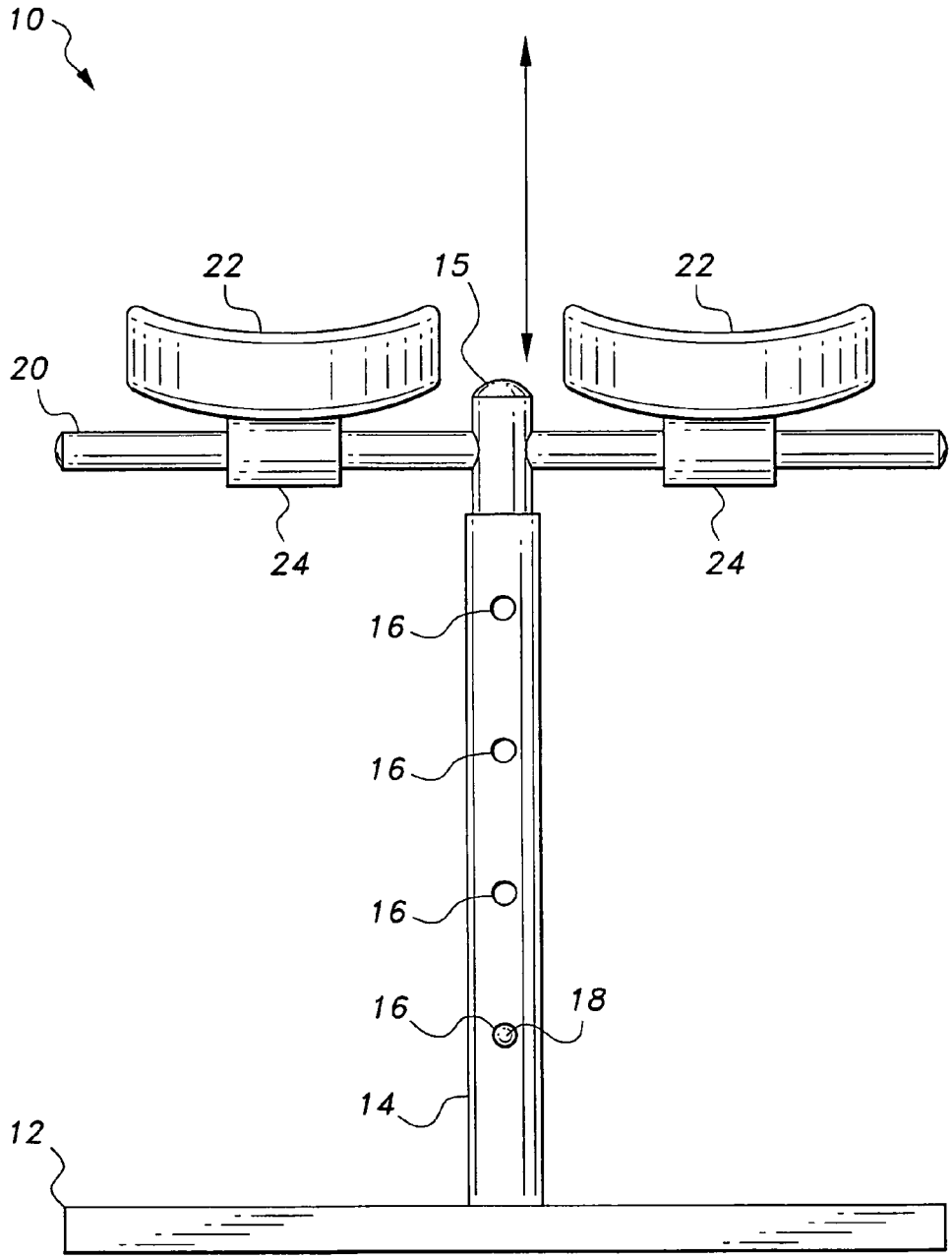
FIG. 3 is a front view of the adjustable leg rest according to the present invention.

A vertical support 14, having opposed upper and lower ends, is further provided, with the lower end thereof being secured to the upper surface of the base 12. As best shown in FIG. 3, the vertical support 14 has an adjustable height (indicated by the directional arrows) and may be a telescopic tube or the like. Preferably, a plurality of apertures 16 are formed through the telescopic tube of vertical support 14, allowing a locking detent 18, also mounted on the tube of support 14, to selectively engage one of the apertures 16. This allows the user to selectively adjust and lock the height of vertical support 14. It should be understood that any suitable positioning and locking device may alternatively be utilized for this purpose.

A horizontal support 20 is secured to the vertical support 14, adjacent the upper end thereof, with the horizontal support 20 having laterally opposed first and second ends. First and second support pads 22 are secured to the horizontal support 20, with each of the first and second support pads 22 being respectively positioned adjacent one of the first and second ends of the horizontal support 20.

Figure 4:
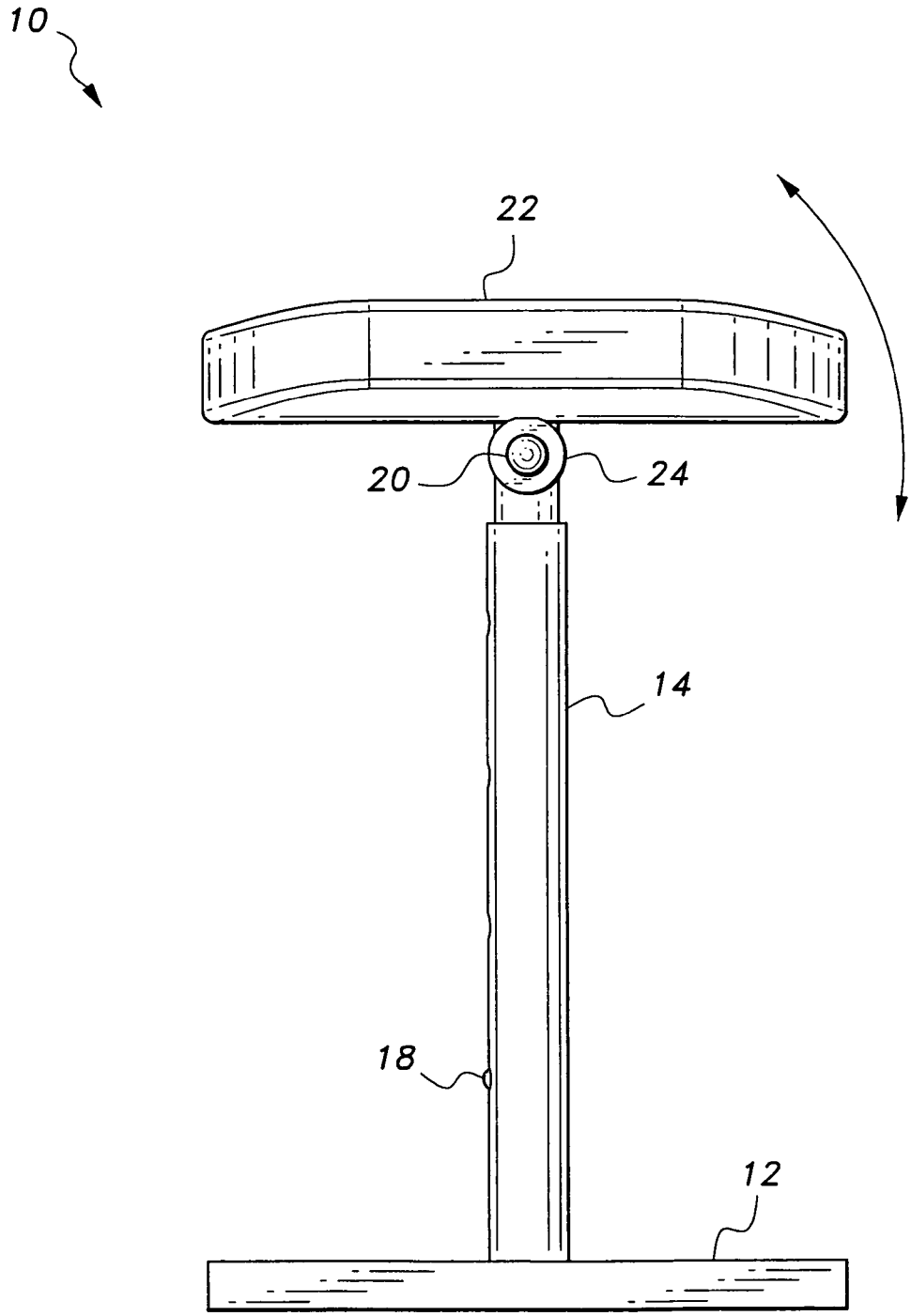
FIG. 4 is a side view of the adjustable leg rest according to the present invention.

As best shown in FIG. 4, each of the first and second support pads 22 is angularly adjustable with respect to the horizontal support 20 (indicated by the directional arrows in FIG. 4). The support pads 22 are formed as cushions or the like, and each has an upper surface adapted for supporting a leg of the user. The cushioned support pads 22 may be covered with decorative fabric, depending upon the desires of the user. Base 12, vertical support 14 and horizontal support 20 may be formed from metal, wood, plastic or any other suitable, structurally strong and stable material. The base 12, vertical support 14 and horizontal support 20 may be coated with paint or finish, dependent upon the user's desires.

As best shown in FIGS. 3 and 4, the horizontal support 20 preferably has a cylindrical contour, and a pair of collars 24 are mounted on the opposed first and second ends of the horizontal support 20. A lower surface of each support pad 22 is secured to a respective one of collars 24. Collars 24 are rotatable about horizontal support 20, and are angularly held in place by frictional engagement therewith. Collars 24 may further be horizontally adjustable to adjust the width between the support pads.

Figure 5:
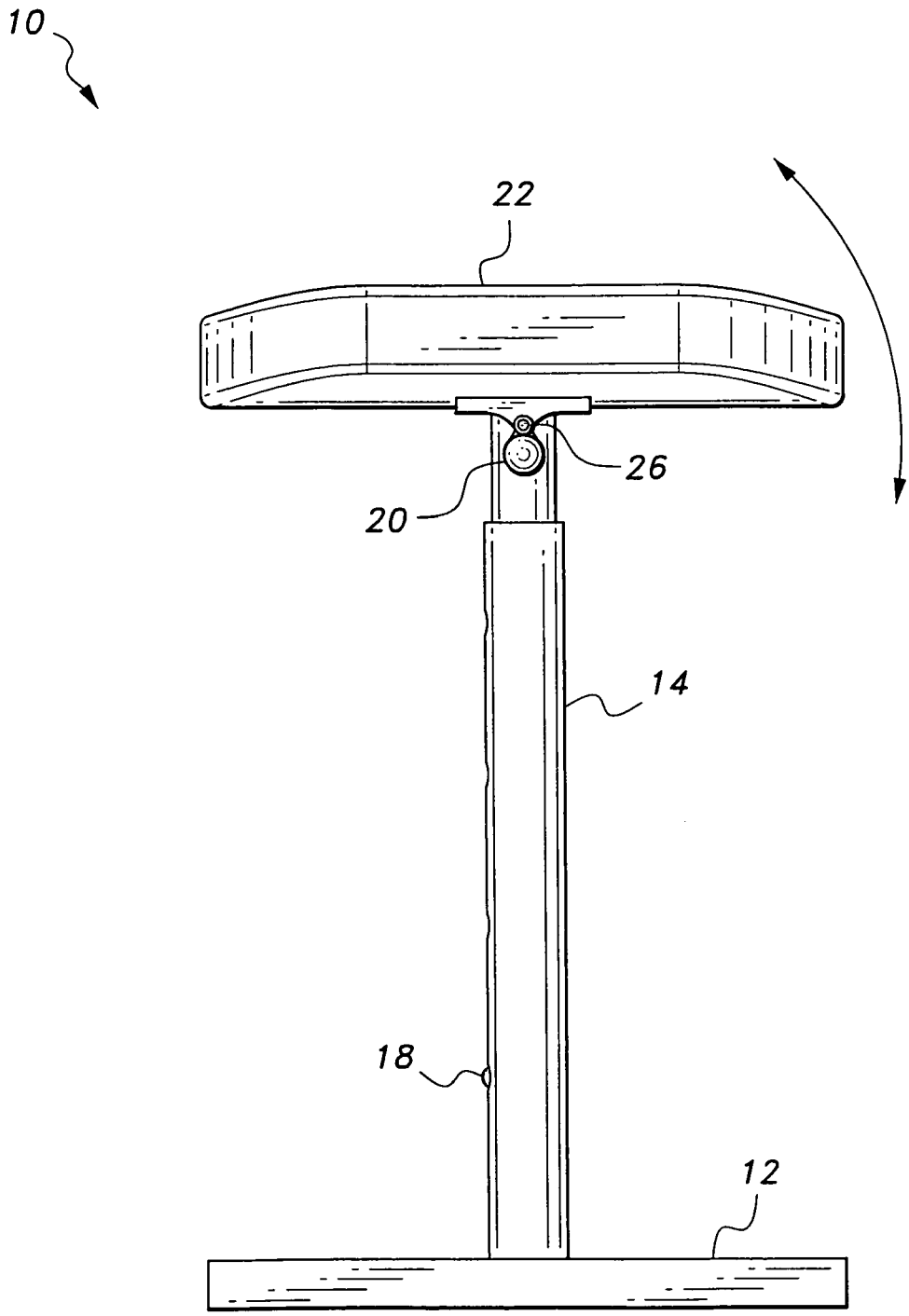
FIG. 5 is a side view of an alternative embodiment of an adjustable leg rest according to the present invention.
Figure 6:
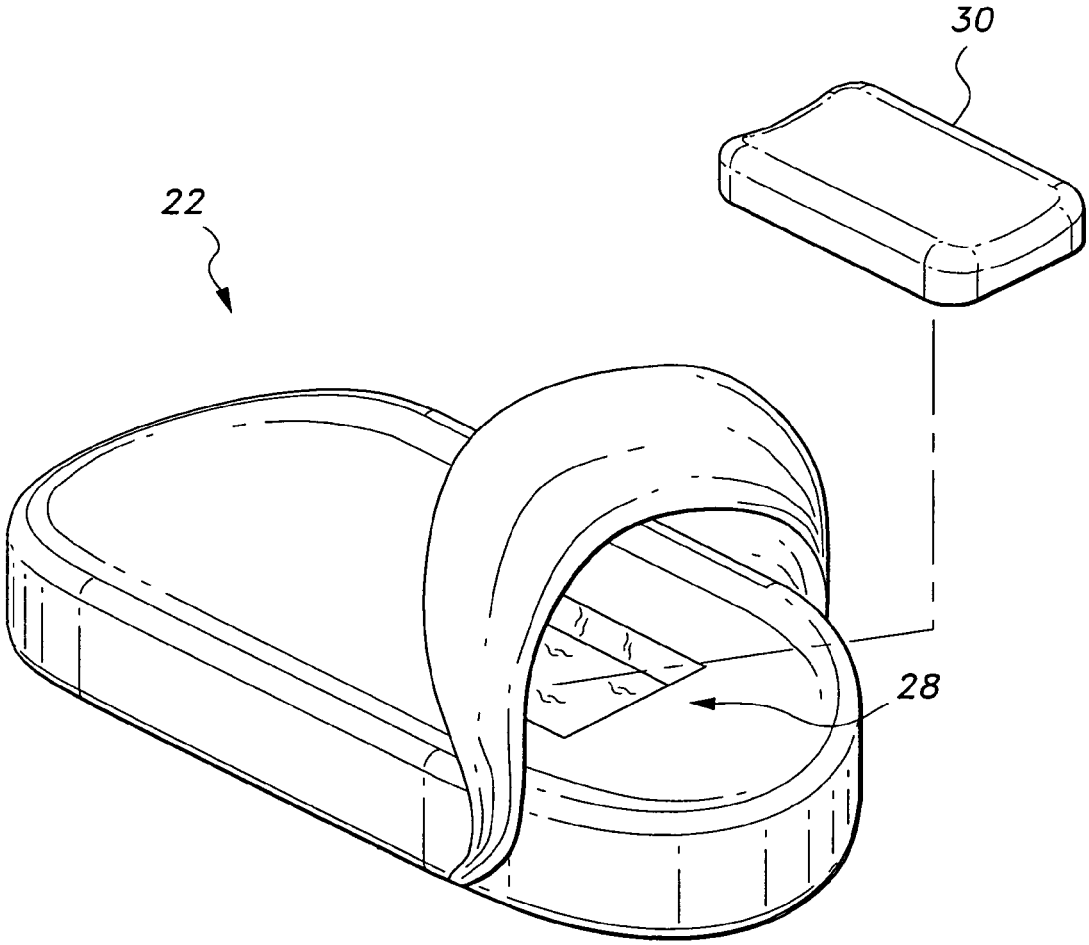
FIG. 6 is an exploded perspective view of a cushioned support pad and associated vibrator for use with the adjustable leg rest according to the present invention.

It should be understood that any pivotal mechanism may be utilized to fix support pads 22 to horizontal support 20, and allow angular adjustment thereof. In the alternative embodiment of FIG. 5, collars 24 are each replaced by an exemplary hinge 26. Further, as shown in FIG. 6, a pocket 28 may be formed on the outer surface of each support pad 22, allowing a battery operated vibrator 30 or the like to be inserted therein. Vibration of pads 22 will generate a massage-type effect on the user's legs and aid in increasing blood circulation therein.

It is to be understood that the present invention is not limited to the embodiments described above, but encompasses any and all embodiments within the scope of the following claims.

I claim:

1. A portable adjustable leg rest, consisting essentially of:

a planar base having a planar upper surface and a planar lower surface;

a vertical support having opposed upper and lower ends, the lower end thereof being secured to the base, the vertical support comprises a telescopic tube thereby having an adjustable height;

a horizontal support attached to the upper end of the vertical support, the horizontal support having laterally opposed first and second ends;

first and second support pads disposed on the horizontal support, each of the first and second support pads being respectively positioned adjacent one of the first and second ends of the horizontal support and being horizontally adjustable along its respective end, each of the first and second support pads having an upper surface adapted for supporting a leg of a user, each of said first and second support pads is angularly adjustable with respect to said horizontal support.

2. The adjustable leg rest as recited in claim 1, further comprising means for selectively adjusting and locking the height of the telescopic tube.

3. The adjustable leg rest as recited in claim 2, wherein said means for selectively adjusting and locking the height of the telescopic tube comprises a locking detent, the locking detent selectively engaging one of a plurality of apertures formed through the telescopic tube.

4. The adjustable leg rest as recited in claim 1, further comprising means for pivotally securing each of said first and second support pads to said horizontal support.

5. The adjustable leg rest as recited in claim 4, further comprising first and second collars pivotally mounted to the first and second ends of said horizontal support, respectively, said first and second support pads being respectively secured to the first and second collars.

6. The adjustable leg rest as recited in claim 4, wherein said means for pivotally securing each of said first and second support pads to said horizontal support comprise a pair of hinges secured to the first and second ends of said horizontal support, each said hinge being further secured to one of said first and second support pads.

7. The adjustable leg rest as recited in claim 1, further comprising a pair of vibrators, each said vibrator being removably received within a respective pocket formed in an outer surface of one of said first and second support pads.

* * * * *